US009784021B2

(12) United States Patent
Torka et al.

(10) Patent No.: US 9,784,021 B2
(45) Date of Patent: Oct. 10, 2017

(54) MOTOR VEHICLE DOOR LOCK

(71) Applicant: HUF HÜLSBECK & FÜRST GMBH & CO. KG, Velbert (DE)

(72) Inventors: Artur Torka, Hattingen (DE); Udo Orzech, Velbert (DE); Stephan Wietkamp, Münster (DE)

(73) Assignee: Huf Huelsbeck & Fuerst GmbH & Co. KG, Velbert (DE)

( * ) Notice: Subject to any disclaimer, the term of this patent is extended or adjusted under 35 U.S.C. 154(b) by 7 days.

(21) Appl. No.: 14/388,471

(22) PCT Filed: Mar. 15, 2013

(86) PCT No.: PCT/EP2013/055339
§ 371 (c)(1),
(2) Date: Sep. 26, 2014

(87) PCT Pub. No.: WO2013/143875
PCT Pub. Date: Oct. 3, 2013

(65) Prior Publication Data

US 2015/0061301 A1 Mar. 5, 2015

(30) Foreign Application Priority Data

Mar. 29, 2012 (DE) ..... 10 2012 102 724

(51) Int. Cl.
*E05C 3/06* (2006.01)
*E05B 85/20* (2014.01)
(Continued)

(52) U.S. Cl.
CPC ..... *E05B 85/20* (2013.01); *E05B 15/04* (2013.01); *E05B 77/36* (2013.01); *E05B 81/14* (2013.01);
(Continued)

(58) Field of Classification Search
CPC ..... E05B 77/36; Y10S 292/61
(Continued)

(56) References Cited

U.S. PATENT DOCUMENTS

2010/0127512 A1 5/2010 Vazquez et al.
2010/0170308 A1* 7/2010 Wattebled ..... E05B 81/20 70/77
2011/0012376 A1* 1/2011 Hunt ..... E05B 85/26 292/216

FOREIGN PATENT DOCUMENTS

DE 19812606 A1 9/1999
DE 102007024672 A1 11/2008
EP 1387027 A2 2/2004

OTHER PUBLICATIONS

International Preliminary Report on Patentability and Written Opinion of International Application No. PCT/EP2013/055339 dated Oct. 1, 2014 and English Translation, 27 pages.
(Continued)

*Primary Examiner* — Mark Williams
(74) *Attorney, Agent, or Firm* — Fay Sharpe LLP

(57) ABSTRACT

A motor vehicle door lock includes a rotary latch which in a locking position encompasses a locking element that is pre-tensioned in a direction of an open position releasing the locking element. A pawl is in engagement with the rotary latch such that the latch is inhibited from moving towards the open position. A coupling section of the pawl is coupled to a drive element which moves the pawl between an engagement position and a release position, the release position allowing the rotary latch to move toward the open position. A force is applied to the pawl only in the engagement position thereof and the force application holds the pawl in engagement with the rotary latch.

13 Claims, 9 Drawing Sheets

(51) Int. Cl.

| | |
|---|---|
| ***E05B 77/36*** | (2014.01) |
| ***E05B 81/14*** | (2014.01) |
| ***E05B 81/68*** | (2014.01) |
| ***E05B 15/04*** | (2006.01) |
| *E05B 77/06* | (2014.01) |
| *E05B 81/20* | (2014.01) |
| *E05B 47/00* | (2006.01) |
| *E05B 85/26* | (2014.01) |

(52) U.S. Cl.
CPC ..... *E05B 81/68* (2013.01); *E05B 77/06* (2013.01); *E05B 81/20* (2013.01); *E05B 85/26* (2013.01); *E05B 2047/0065* (2013.01); *Y10T 292/1043* (2015.04)

(58) Field of Classification Search
USPC ..... 292/294, 201, 216, DIG. 23
See application file for complete search history.

(56) References Cited

OTHER PUBLICATIONS

International Search Report of International Application No. PCT/EP2013/055339 dated Sep. 16, 2013, 10 pages.

* cited by examiner

MOTOR VEHICLE DOOR LOCK

BACKGROUND

This invention concerns a motor vehicle door lock mechanism with a rotary latch that surrounds a locking element in the device's locking position and that is preloaded in the direction of the locking element when the device is in the open position, a locking pawl that is positioned in relation to the rotary latch when in the engagement position in such a way that the rotary latch is prevented from moving in the direction of the open position, and a drive element, which is used to couple a coupling section of the locking pawl and that moves the locking pawl between the engagement position and a release position, at which the locking pawl is not engaged with the rotary latch so that the rotary latch can move in the direction of the open position.

A motor vehicle door locking mechanism of the aforementioned kind is, for example, recognized in DE 10 2007 024 672 Al and is, among other fields, used for tailgates of motor vehicles. Such a motor vehicle door lock comprises a locking element often equipped with a rotary latch and connected to a boot lid as well as a counter part for the lock connected to the body of the vehicle, which could, for example, be in the form of a locking clip or latchbolt. In order to open the tailgate, the user actuates a control mechanism (for example using an electronic key), which causes the tailgate to be opened using a drive element that would preferably be operated by an electric motor. As part of this opening process, a pivotally mounted locking pawl is guided out of the engagement position (at which the locking pawl usually connects with the rotary latch as forced by a spring mechanism) by the drive element to such an extent that it reaches the release position and the rotary latch is no longer engaged, which allows for a rotary motion of the rotary latch out of the locking position and in the direction of the opening position. The movement of the locking pawl from the engagement position to the opening position takes place in opposition to the force exercised by a spring element, due to the fact that the locking pawl is spring-loaded and pre-stressed in the direction of the locking position. The motor of the drive element therefore has to be dimensioned accordingly, though the smallest possible and therefore less powerful ones are preferred, which then reduces the power requirements of the door locking mechanism again.

The fact that the tailgate is generally pre-stressed in the direction of a seal when in the locking position generally has to be considered when further developing an already advanced motor vehicle door locking mechanism. This "pre-stress" refers to the circumstance that the seal back pressure caused by the flap seal counteracts the closing of the vehicle's rear lid. That is the reason why there is a higher pressure in the opening direction of the tailgate due to the compressed nature of the tailgate's seal. If the locking pawl is no longer engaged with the rotary latch, the pressure that has built up due to the sealing in the form of a so-called "discharge blow" and the tailgate suddenly and abruptly moves towards the opening direction, which negatively manifests itself as an audible opening sound (that could be interpreted as an adverse effect on the perceived comfort of the mechanism or the vehicle as a whole).

In addition, the locking element positioned in the rotary latch trap of the rotary latch when in the locking position can cause undesired rattling noises due to intended tolerances, which has an adverse effect on the perceived comfort, similar to the opening sound. The invention is based on the task of finding a solution that provides a reliable and compact motor vehicle door locking mechanism that is both simple and cost-effective to construct as well as functions using merely a low-power motor while at the same time ensuring that the noise development of the provided locking function is, overall, reduced to a minimum.

With a motor vehicle door lock of the previously described type, these problems are solved, in accordance with the invention, by only exercising a force on the locking pawl while it is in the engagement position and by ensuring that this force keeps the locking pawl engaged with the rotary latch.

BRIEF SUMMARY.

These problems are also addressed by a door lock mechanism of the aforementioned type and in accordance with the invention by providing a lever-like signal element that can be rotated around a rotational axis, whose rotary position shows the engagement position of the locking pawl.

Another factor regarding this aforementioned type of door locking mechanism in accordance with the invention is the circumstance that the locking element is held in a motion-inhibiting and clamping manner by the rotary latch and a restraining element that can be swiveled around a pivot axis and that is coupled with the rotary latch when the element is in its locking position.

Lastly, the motor vehicle door locking mechanism of the aforementioned type in accordance with the invention is also characterized by the fact that the drive element moves the locking pawl in the direction of the release position during the movement to the opening position in such a way that the rotary pawl, which is still engaged with the rotary latch as before, moves in the direction of the opening position.

Advantageous and purposeful embodiments and further developments of this invention result from the applicable sub-claims.

This invention provides a vehicle door locking mechanism, which serves to contribute to an increase in comfort and quality of locking mechanisms and their functionality. The vehicle door locking mechanism in accordance with this invention is characterized by a functional design and features a simple, cost-effective and compact overall construction.

With the trigger mechanism in accordance with the invention, the drive element moves the locking pawl in the direction of the release position during the movement to the opening position in such a way that the rotary pawl, which is still engaged with the rotary latch as before, moves in the direction of the opening position. Given the trigger mechanism of the motor vehicle door lock in accordance with the concerned invention, the locking pawl and the rotary latch are still engaged with one another during the movement of the locking pawl in the direction of the release position. This movement of the locking pawl does, however, not allow for the opening of the tailgate. But this motion (the first or initial one) does, on the other hand, cause the pre-stress of the tailgate to be relieved during the opening process, due to the fact that the defined motion of the locking pawl causes a relative motion between the motor vehicle door lock and the locking element and therefore results in a pressure relief for the tailgate, causing the rotary latch to be rotated to the opening position by a predetermined rotary movement. This ultimately allows the tailgate to be moved by a predefined stroke relative to the locking element, which results in the pre-stress and the pressure to be relieved that had been responsible for the audible and annoying opening noise experienced with door locking mechanisms of the past. The invention therefore allows the pre-stress between the tailgate or the vehicle door locking mechanism and the locking element to be reduced before the locking pawl and the rotary latch are moved out of engagement.

Regarding annoying rattling noises of the locking element held within the rotary latch, the invention provides an immobilization element to alleviate these issues often encountered with previous door locking mechanisms. This immobilization element causes the locking element to be clamped between the rotary latch and the immobilization element in the locking position of the rotary latch so that a relative motion of the locking element, which is responsible for the annoying rattling noise, is prevented. In order to ensure that the clamping force does not oppose the opening of the vehicle door locking mechanism, the immobilization element is coupled to the rotary latch, which ensures that a movement of the rotary latch out of the locking position into the opening position also causes the immobilization element to be moved accordingly and the locking element to be released.

In accordance with the invention, the compactness of the motor vehicle door locking mechanism is increased by the signal element and/or the circumstance that the locking pawl is only force-actuated in the engagement position. The force that is only applied to the locking pawl in the engagement position allows for the usage of a motorized opening aid, which only has to deliver the force required to move the locking pawl to the opening position. The locking pawl in accordance with the invention can, for example, only be spring-loaded in the engagement position. As soon as the locking pawl is moved out of the engagement position, the spring force is not exerted on the locking pawl any more. In this case, no additional force is then required to overcome a possibly applying spring force. The locking pawl undergoes a kind of "load change" during the motion from the engagement position to the release position, though the locking pawl is not spring-loaded outside of the engagement position. With the current state of the art, the locking pawl is spring-loaded even when it is outside of its engagement position, which means that an additional force is required to overcome the applied spring force in addition to the force needed to swivel the pawl to the open position. With this invention, that is no longer necessary; meaning that even a low-power motorized drive can be used to operate the door locking mechanism. Due to the lower power requirements regarding the motorized drive unit, it is possible to use a smaller motor so that the overall construction space for the vehicle door locking mechanism is smaller and the door locking mechanism is more compact. In addition, the costs for the manufacturing of the vehicle door locking mechanism are decreased due to the lower power requirements as well as the smaller space needs. Due to the signal element in accordance with the invention, which can be rotated around a rotary axis in a manner similar to a rocker, only a single sensor is now required in comparison to the current state of the art in order to detect the main latching position or the engagement position of the locking pawl or the closed position of the vehicle door locking mechanism.

Regarding an embodiment of the invention, it is advantageous concerning the application of force to the locking pawl that a contact area of the locking pawl is pressed against a stop element when in the engagement position in such a way that a locking section, which is located in the contact area opposite the locking pawl, is subjected to a force in the direction of the rotary latch. Pressing the stop element against the contact area causes the locking pawl to be rotated around the joint axis in such a way that a locking section of the locking pawl is pushed into the engagement position.

In this regard, the stop element can also be designed as an elastic stop surface in a further embodiment or development of the concerned invention. In particular, it is possible to design the stop element as a spring element with one leg of the spring element pushing against the contact area of the locking pawl in the closing position and the other leg resting on a housing element of the vehicle door locking mechanism in a fixed manner, while a movement of the locking pawl out of the engagement position results in the first leg of the spring element being moved and no longer being in contact with the contact area.

Regarding the lever-like signal element that can be rotated around a rotary axis, the embodiment of the invention makes the rotary position of the signal element dependent on the position of the drive element, while the drive element exhibits a guiding rod, which pushes against the guide base on the signal element when the rod is moved out of the engagement position and thereby rotates the signal element. In this way, a rotation of the drive element automatically causes the signal element to be deflected, which results in the circumstance being detected that the locking pawl is no longer in the engagement position.

It is then particularly advantageous if the signal element cooperates with a sensor in such a way that the rotation of a signal element with a simultaneous movement of the locking pawl out of the engagement position actuates an actuating element of the sensor using an actuating surface on the signal element. This actuation would be equivalent to a signal indicating the operating state of the vehicle door locking mechanism, which is why a further embodiment or development in accordance with the invention includes a functionality that an actuation of the actuating element of the sensor shows that the locking pawl is no longer in the engagement position. In accordance with a further embodiment, this means that the actuation element of the sensor is not actuated in the engagement position of the locking pawl, so that the motor no longer has to be supplied with power and can therefore be interrupted for efficiency reasons and power only has to be restored if the locking pawl is to be deflected out of the engagement position again.

Regarding the immobilization element, which clamps the locking element together with the rotary latch in its locking position, the embodiment of the invention intends that the immobilization element is coupled to the rotary latch in such a way that a movement of the rotary latch in the direction of the opening position moves the immobilization element away from the rotary latch in order to "release" the locking element. In this way, it is ensured that the immobilization element is only in the corresponding position if the locking element is actually supposed to be held in a certain position and its movement be inhibited.

With the embodiment of the invention, the coupling of the rotary latch and the immobilization element can be implemented in an easy to construct and mechanically simple manner, if the rotary latch exhibits a radially offset setting element, which moves the immobilization element away from the rotary latch if the rotary latch is moved towards the opening position.

In order to ensure that the immobilization element is only kept in the corresponding position if the locking element is actually supposed to be held in a movement-inhibiting fashion, the invention in its embodiment intends that the immobilization element is positioned and held at an idle position away from the rotary latch when the rotary latch is in the opening position.

In accordance with the invention, this restraining of the immobilization element in the stopping position is done using a latching element on the immobilization element, which engages with a latching end of the rotatable and lever-like signal element when in the latching position.

In order to ensure that the locking element is immobilized if it is held in place by the rotary latch in the locking position, it is particularly advantages for the embodiment of the invention if the immobilization element is equipped with a curved stopping edge, which also presses against the locking element in the locking position of the rotary latch. In this regard, it is, so-to-speak, laterally surrounded by the curved stopping edge in the locking position of the locking element, so that a mutual "sliding" of the locking element and the immobilization element is prevented. It should, in this regard, be noted that the locking element is held in the "depression" of the curved stopping edge in the locking position.

The embodiment of the door locking mechanism invention intends that the motion of the drive element is a rotary motion that causes a primarily tangential movement of the locking pawl in relation to the rotary latch while the locking pawl moves out of the engagement position in the direction of the release position and then, in order to stop the locking pawl and rotary latch from engaging, causes a movement of the locking pawl that is primarily radial and facing away from the locking pawl. This movement relates to a latching portion of the locking pawl, which is engaged with the locking pawl in the engagement position. In other words, the drive element used to open the vehicle door lock is rotated in such a manner that the locking pawl or at least a section of the locking pawl, meaning the locking section, is first moved primarily tangentially in relation to the locking pawl during the movement out of the engagement position in the direction of the release position and then, in order to move the locking pawl and rotary latch out of engagement again, moved radially away from the rotary latch. The movement of the locking pawl performed during the opening process of the vehicle door lock is therefore divided into two parts or consists of a sequence of movements in which the locking pawl is moved in at least two different directions in space. In order to relieve the pressure of the tailgate in the locking position, a primarily tangential movement of the locking pawl is performed in relation to the rotary latch. However, during this movement the locking pawl is still engaged with the rotary latch as before, although the rotary latch is enabled to turn to the opening position depending on the tangential distance which the locking pawl is moved, which causes the pressure of the tailgate to be relieved. Only after this pressure has been relieved or the pre-tension has been reduced, the rotary latch is then moved out of engagement with the locking pawl using a radial and lateral movement of the latter, which releases the locking element in order to open the tailgate. The opening movement of the locking pawl that is composed of two movements into different directions in space therefore allows the pre-tension or pressure on the tailgate in the locking position to be relieved by the locking pawl causing a controlled motion of the tailgate in the opening direction for a certain stroke length.

It can furthermore be considered as advantageous if the coupling section coupled to the drive element is mounted on a joint axis in a rotatable manner. As a further development of the invention, a reduction of the opening noise by reducing the pre-tension between the tailgate or the vehicle door lock and the locking element before the locking pawl and rotary latch are moved out of engagement is achieved by ensuring that the joint axis translationally moves relative to the rotary axis of the rotary latch during the movement of the locking pawl in the direction of the release position. Although the locking pawl is still engaged with the rotary latch as before during the movement of the joint axis in the direction of the rotary axis, but the rotary latch is allowed to rotate in the direction of its opening position due to the translational and tangential movement of the locking pawl.

A particularly powerful and at the same time efficient way to couple the drive element and the coupling section of the locking pawl can be achieved by using a type of double knee-lever. To this end, this embodiment of the invention provides a push rod element of which the first end is coupled with the drive element in a rotatable and radially offset manner in relation to the rotational axis of the drive element and a second end that catches the coupled joint axis of the coupling section of the locking pawl, whereas the first end of the articulated lever is mounted on a guiding axis on the housing element in a locationally fixed yet rotatable fashion and a second end of the articulated lever mounts the push rod element and the joint axis coupled with the locking pawl in such a way that it can be rotated and swiveled. A first knee lever is therefore defined by the second end of the push rod element and the fixedly mounted articulated lever, whereas the locking pawl is coupled with the articulated lever and the push rod element via the joint axis. A second knee lever is defined by the first end of the push rod element and its eccentric and radially offset coupling with the drive element in relation to the rotational axis.

In order to increase safety in the event of a vehicle accident during which accelerative forces act on the vehicle door locking mechanism and may lead to the locking pawl and/or rotary latch being deflected in such a way that they are taken out of the engagement position in an undesired manner, the invention provides the locking pawl with a bend, which is in contact with the guide axis that acts as a final stop and inhibits a movement of the locking pawl outside the movement range of the engagement position while in the engagement position. In the position where the bend of the locking pawl is in contact with the guide axis, meaning in the engagement position, the push rod (or its line of force) takes up a position in which it has exceeded a certain dead point and is therefore locked in the engagement position in a self-locking manner with the guide axis acting as a mechanical stop.

Furthermore, in order to ensure that the pre-stress with which the tailgate has been pre-stressed into the locking position is discharged gradually and not abruptly, it would be advantageous regarding the embodiment of the invention, if the movement from the engagement position into the direction of the release position of the coupling section of the locking pawl that is mounted on the joint axis, is, in fact, a movement similar to a circular section. Movements in the form of a quarter circle or half circle would be feasible.

It goes without saying that the aforementioned characteristics as well as those yet to be described further down below are not only usable in the stated combination, but also in other combinations or by themselves altogether without departing from the scope of the concerned invention. The scope of the invention is merely defined by the indicated claims.

BRIEF DESCRIPTION OF THE DRAWINGS

Additional details, characteristics and advantages of the invention result from the following descriptions in conjunction with the drawings, which are used to portray an advantageous embodiment example of the invention in an exemplary manner. In the enclosed drawings.

DETAILED DESCRIPTION

Figure 1:
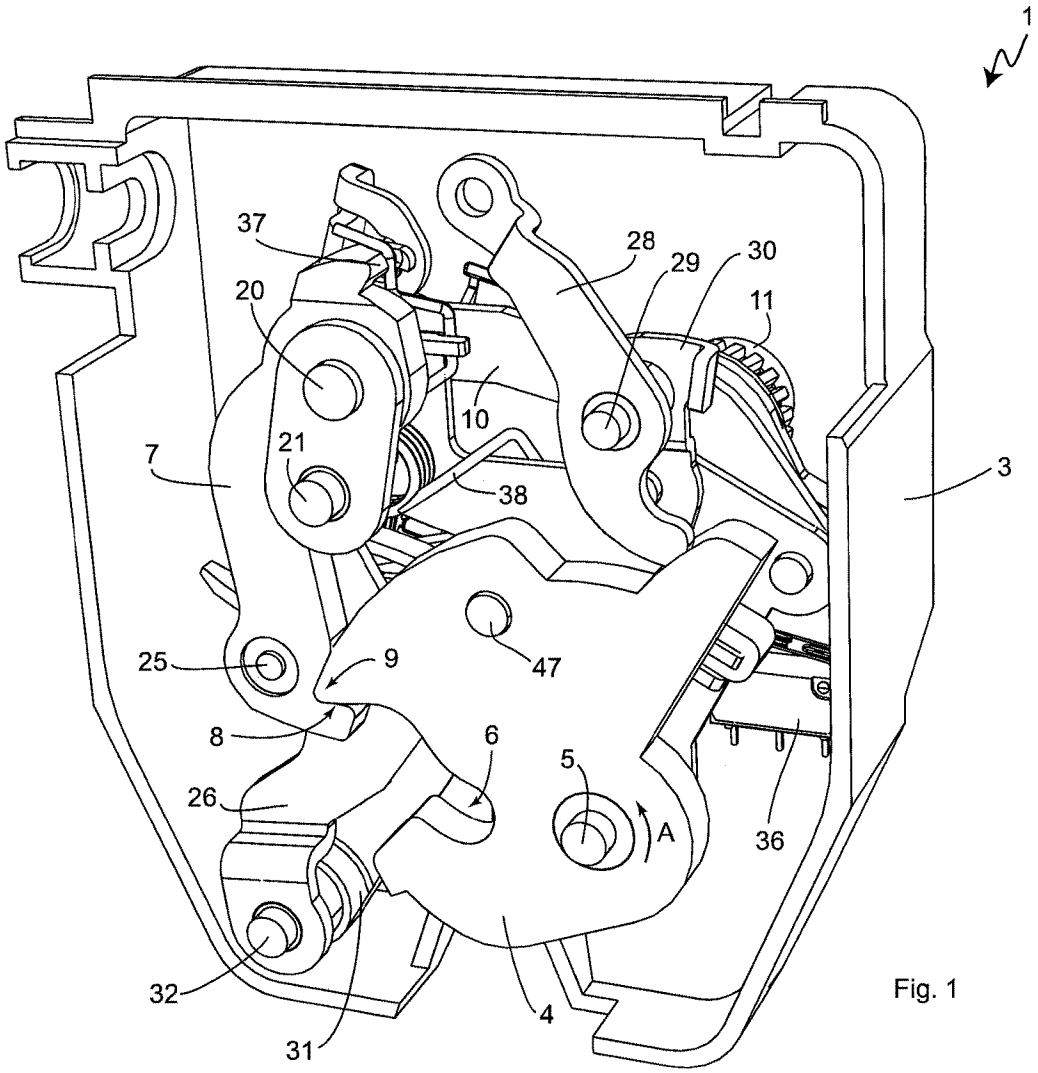
FIG. 1 shows a perspective view of the vehicle door locking mechanism in accordance with the invention in an assembled state.
Figure 13:
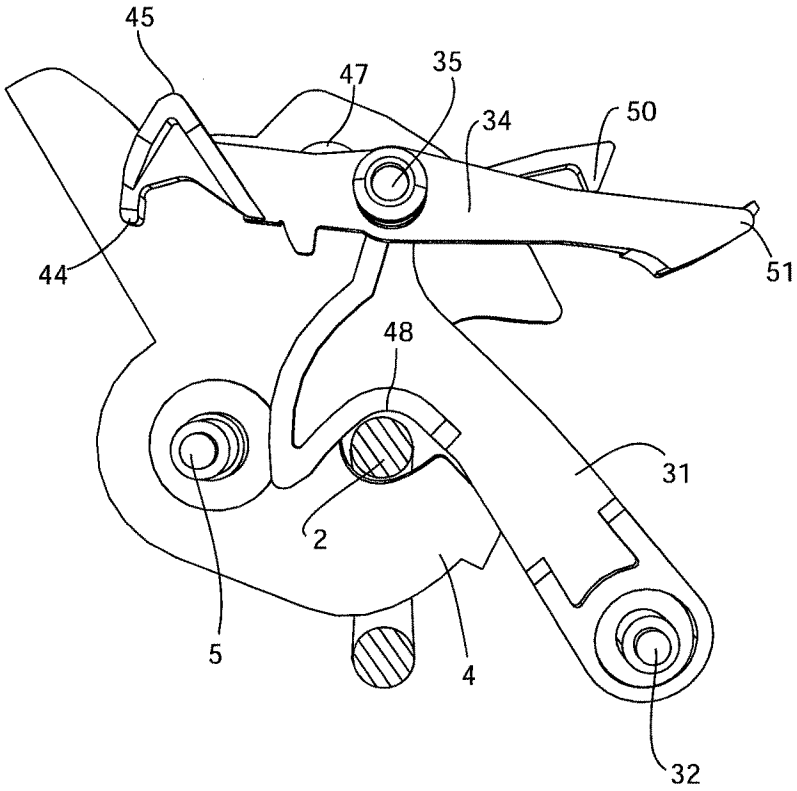
FIG. 13 shows a rear view of the interaction of the rotary latch with an immobilization element in the closed/locked position.

FIG. 1 contains a perspective view of the motor vehicle door locking mechanism "1", in particular a tailgate lock assembly, in accordance with the invention. The motor vehicle door lock "1" that can be mounted on the tailgate of a motor vehicle, engages with a locking element "2", which is only schematically portrayed in FIGS. 4 and 13, for the purpose of closing and locking the tailgate. The locking element "2" could be designed as a locking bolt or locking clip and be mounted on the vehicle frame. The vehicle door locking mechanism "1" comprises a housing element "3", which is used to mount and house additional components of the vehicle door locking mechanism "1". In order to prevent visual obstructions, the housing element "3" is merely portrayed in FIG. 1. As can be seen in FIGS. 1 to 5, the motor vehicle door locking mechanism "1" also comprises a rotary latch "4", which is rotationally mounted on the housing element "3" around a locationally fixed rotary axis "5" and is also provided with a rotary latch trap "6", which the locking element "2" engages with. The rotary latch "4" is pre-stressed by a spring element (not portrayed in detail) to such an extent that it is biased to rotate counter-clockwise in the direction of arrow "A" while in the closed position as portrayed in FIGS. 1 and 4, so that the locking element "2" is released in a downward direction (in relation to FIG. 4).

Figure 4:
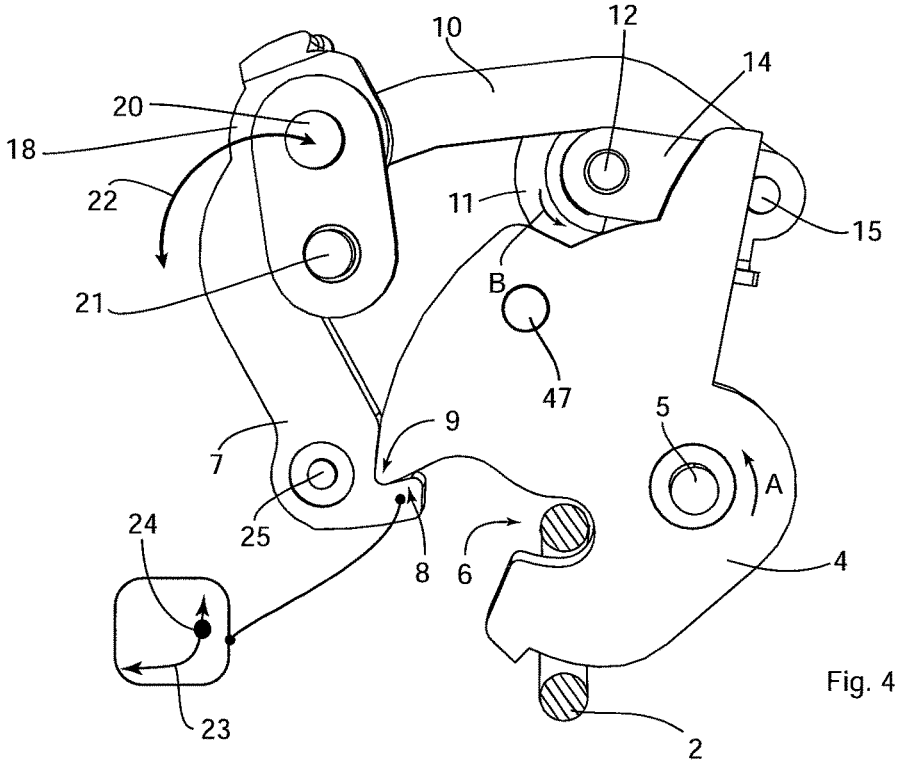
FIG. 4 shows a plan view of the vehicle door locking mechanism in the closed/locked position.

In order to prevent an unintentional release while in the closed/locked state as portrayed in FIGS. 1 and 4, the rotary latch "4" is held in place by a locking pawl "7", due to the circumstance that a locking section "8" of the locking pawl "7" is engaged with a locking arm "9" on the rotary latch trap "6". In this regard, the locking pawl "7" can also be pre-stressed or spring-loaded in addition to the rotary latch "4" while in the engagement position using the spring element in order to maintain the engagement position with the rotary latch. The position shown in FIGS. 1 and 4 is the so-called "locking position" of the vehicle door locking mechanism, at which the rotary latch "4" is in a closing/locking position and the locking pawl "7" is in an engagement position. In the locking position, the pre-stressed rotary latch "4" with the locking arm "9" presses on the locking section "8" of the locking pawl "7", which catches the locking element "2" in the rotary latch trap "6", as can be seen in FIG. 4. In other words, the rotary latch "4" is pre-stressed in an opening direction that would release the locking element "2". In the engagement position, the locking pawl "7" is engaged with rotary latch "4" in such a manner that the rotary latch "4" is prevented from moving in the direction of the opening position (the opening position is portrayed in FIG. 5).

Figure 5:
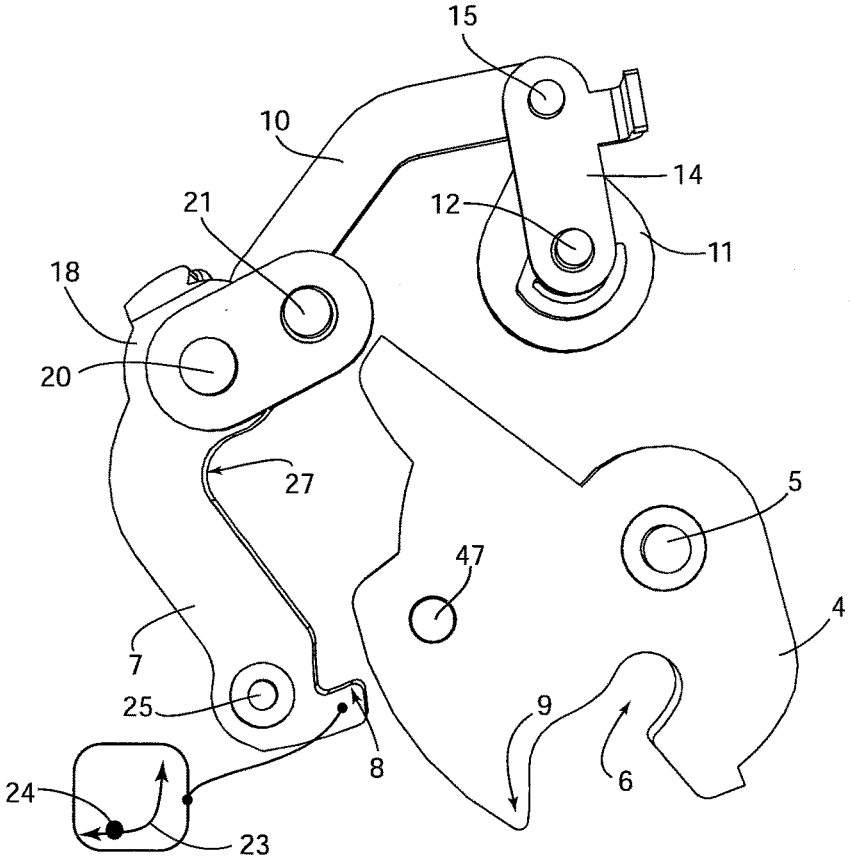
FIG. 5 shows a plan view of the vehicle door locking mechanism in the opened/unlocked position.

The locking pawl "7" is coupled with a drive element "11" shown in FIGS. 1 to 5 given an interposition of a push rod element and/or a push rod "10". The tooth geometry of the drive element "11" apparent in the Figures, is engaged with a motorized opening aid (not shown in the figures), which could, for example, be designed as a motor with a worm gear and oblique toothing. The drive element "11", which could be designed as a disc-shaped device, is rotationally mounted on housing element "3" around a rotational axis "12" in a locationally fixed manner and possesses a radial extension "13" (that can be seen in FIG. 3), which protrudes past the peripheral edge of the drive element "11". In FIGS. 4 and 5, which show the closed and/or open position of the vehicle door locking mechanism "1" based on the essential components of the rotary latch "4", the locking pawl "7", the push rod "10" and the drive element "11", the radial extension "13" is overlapped by a transmission lever "14", whose ends are attached to the rotational axis "12" and a transmission axis "15" mounted on the end of the radial extension "13". The transmission axis "15" is radially offset in relation to the rotational axis "12", whereas the rotational axis "12" is locationally fixed in contrast with the transmission axis "15". In order to transmit the rotary motion of the drive element "11" to the locking pawl "7", so that it can be freely moved between the engagement position and a release position, in which the locking pawl "7" is taken out of engagement with the rotary latch "4", a first end "16" of the push rod element or the push rod "10" is coupled with the drive element "11" at the end of the radial extension "13" on the transmission axis "15", as is shown in the exploded view of FIG. 3. The first end "16" of the push rod "10" is radially offset in relation to the rotational axis "12" of the drive element "11" and mounted on the radial extension "13" in a rotational and/or pivotable manner. The push rod "10" is slightly curved, whereas a second end "17" (see FIG. 3) of the push rod "10" is coupled with a coupling section "18" of the locking pawl "7" and an articulated lever element "19". In this regard, one end of the articulated lever element "19" is rotationally mounted on a joint axis "0", which allows the articulated lever element "19" to guide the movement of the second end "17" of the push rod element "10" and the coupling section "18" of the locking pawl "7" around a guiding axis "21" at a distance. The coupling section "18" of the locking pawl "7" and the second end "17" of the push rod "10" are additionally mounted on the joint axis "20" in a rotatable manner. The other end of the articulated lever element "19" is rotationally mounted on a locationally fixed guiding axis "21". In contrast with the rotary axis "5", the joint axis "25" is not mounted in a locationally fixed manner in relation to the housing element "3", but instead moves translationally along the movement curve "22" only shown in FIG. 4 during the movement of the locking pawl "7" in the direction of the release position, relative to the rotary axis "5" of the rotary latch "4". Due to this movement curve "22", the coupling section "18" of the locking pawl "17" exhibits a movement in the shape of a circular section, which is not a rotational, but rather a translational motion. Thus, a movement in the shape of a circular section is exhibited by the joint axis "20" and a coupling section "18", when the locking pawl "7" moves to the release position (FIG. 5) from the opening position (FIG. 4). The position of the joint axis "20" is therefore not constant in relation to the rotationally fixed rotary axis "5" of the rotary latch "4", but changes during the movement of the locking pawl "7" in the direction of the release position from the opening position. The positional change of the joint axis "20" and the coupling section "18" is caused by the drive element "11", while the push rod "10" transmits the driving force of the drive element "11" to the coupling section "18" of the locking pawl "7".

In order to avoid an audible and annoying opening noise of the pre-stressed tailgate and therefore the vehicle door locking mechanism "1", the mechanism is designed in such a way that the drive element "11" moves the locking pawl "7" in the direction of the release position during the movement from the engagement position so that the rotary latch "4", which is still engaged with the locking pawl "7" as before, moves or rotates in the direction of the opening position during this movement. This movement causes the pressure applied on the tailgate to be released or reduced properly, due to the fact that the tailgate is allowed to move from the locking position by a defined stroke in accordance with the described motion coupling. This motion serving to reduce or avoid the annoying opening noises, is described in detail further down below.

The movement of the locking section "8" of the locking pawl "7" out of its locking or engagement position (portrayed in FIG. 4) into the opening position of the vehicle door locking mechanism "1" (portrayed in FIG. 5) is performed along movement path "23", which is schematically shown in the box next to the vehicle door locking mechanism "1", wherein point "24" distinguishes the current position (engagement position) of the locking section "8" on the movement path "23". The rotary movement of the drive element "11" (indicated by the arrow "B" in FIG. 4) causes the push rod "10" to be pivoted to the position of FIG. 5 from the position shown in FIG. 4. In this regard, the movement of the second end "17" of the push rod "10" is guided along the movement path "22" by the articulated lever element "19" in such a way that it causes the coupling section "18" of the locking pawl "7", which is coupled to the second end "17" of the push rod "10" via the joint axis "20", to move along movement path "22". This coupling causes the coupling section "18" of the locking pawl "7" to undergo a movement that is similar to a circular section. The movement of the locking section "8" out of the engagement position into the direction of the release position, is, however, a primarily tangential movement in the first movement section in relation to rotary latch "4", which is characterized by the vertical course of the movement path "23". The locking pawl "7" is therefore still engaged with the rotary latch "4". However, the tangential movement of the locking section "8" allows the rotary latch "4" to perform a rotary movement in the direction of the opening position so that the pre-stress, which exists with the locking mechanism closed, is relieved without having to open the lock itself. In a second movement section of the locking pawl "7" or the lacking section "8", the locking section "8" is then radially moved away from the rotary latch "4", which is characterized by the primarily vertical course of the movement path "23" in order to take the locking pawl "7" and the rotary latch "4" out of engagement.

As described before, the force of the drive element "11" is first transmitted to a push rod "10", from where the force is then guided onto the coupling section "18" of the locking pawl "7" via the radial extension "13", which corresponds to a transmission lever. During this process, the transmitted force is converted into a defined movement of the coupling section "18" by the articulated lever element "19", as described above. With regard to the force transmission, the articulated lever element "19" defines a first knee lever and the radial extension "13" defines a second one. Both knee levers cause a particularly powerful movement coupling. The second knee lever secures the first knee lever, especially because the torque applied on the second knee lever is very low, which allows it to be well secured by minimal forces. The rotational movement or rotary motion of the drive element "11" in a counter-clockwise direction initially results in a tangential movement of the locking section "8" of the locking pawl "7" in relation to the rotary latch "4". Although the coupling section "18" of the locking pawl "7" moves along the movement path "22" in the shape of a circular section, the locking section "8" of the locking pawl "7" first moves in a primarily tangential manner in relation to the rotary latch "4". Regarding the overall movement of the locking pawl "8", as described above, the movement of the coupling section "18" deviates from the movement of the locking section "8" of locking pawl "7", which follows the movement path "22" in the shape of a circular segment due to the coupling with the drive element "11". The movement of the locking section 28", which is engaged with the rotary latch "4" in the engagement position of the locking pawl "7", is guided using control spigot "25". The movement of the control spigot "25" towards the rotary latch "4" or away from it is guided by a pre-detent lever "26" rotationally mounted on housing element "3". Deviations from this specific embodiment are possible, which can be used to move the locking section "8" of the locking pawl "7" relative to the rotary latch "4".

For reasons of safety, it is also desirable that the motor vehicle door locking mechanism "1" also remains closed in the event of a vehicle accident. The vehicle door locking mechanism "1" therefore has to withstand the accelerative forces that act on the mechanism in the event of a vehicle accident to prevent that the locking pawl "7" and the rotary latch "4" are brought out of engagement. The locking pawl "7" is, to this end, equipped with a bend "27" (see FIGS. 2, 3 and 5), which is contact with the guiding axis "21" that acts as a final stop and limits the movement of the locking pawl "7" beyond the engagement position. In this position, where the bend "27" of the locking pawl "7" is in contact with the guiding axis "21", meaning in the engagement position, the push rod "10" takes up a position in which it has exceeded a certain dead point and is therefore locked in the engagement position in a self-locking manner. The guiding axis "21" serves as a mechanical stop here, which sufficiently limits the movement of the locking pawl "7" from the opening position to the engagement position.

The aforementioned description was directed at the special movement kinematics of the vehicle door locking mechanism "1", which contribute to an opening process that exhibits only a minimal noise development. Before additional characteristics and special technical features of the vehicle door locking mechanism "1" are described in more detail, the constructive layout of the vehicle door locking mechanism "1" is first explained.

Figure 2:
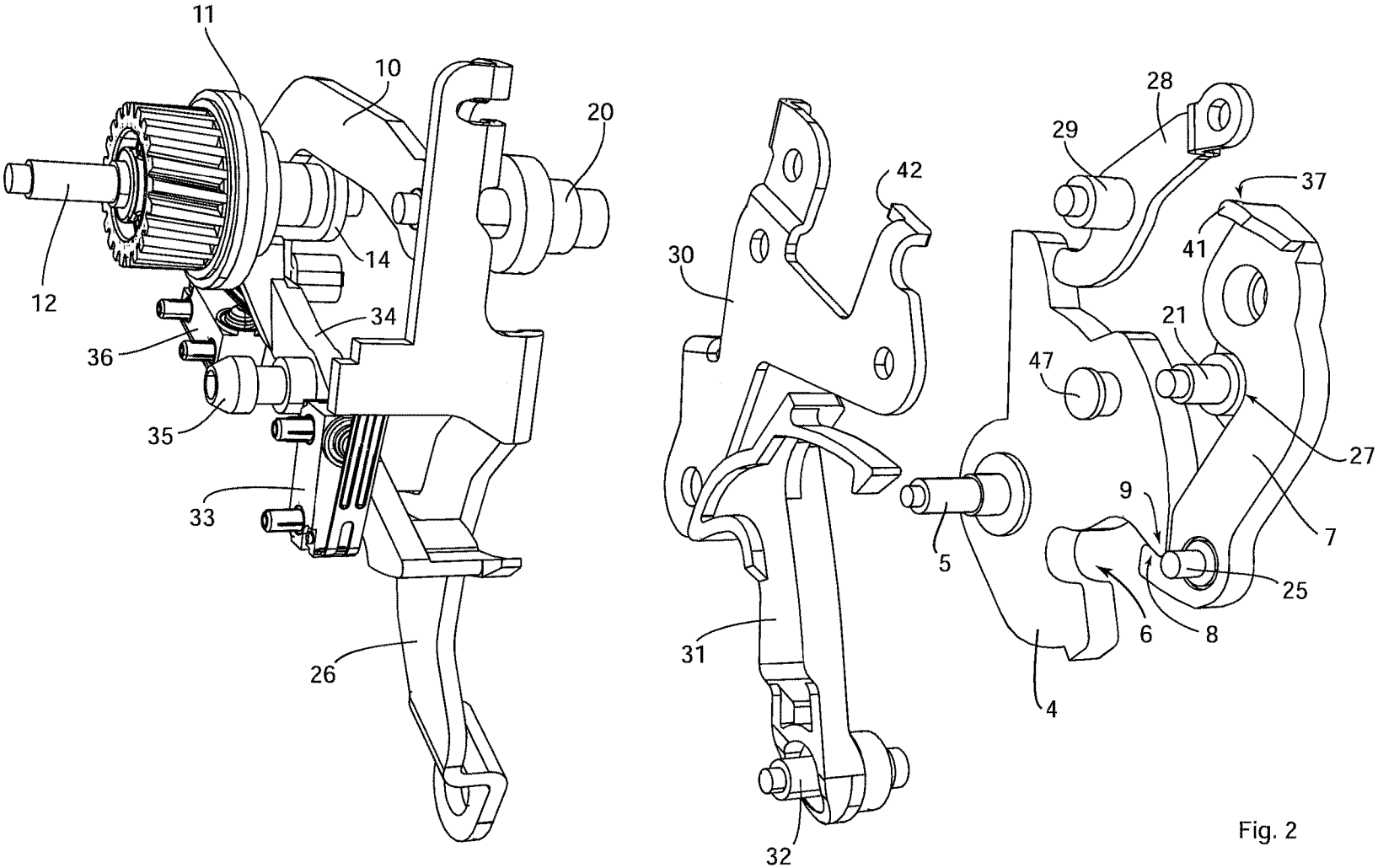
FIG. 2 shows a perspective view of the vehicle door locking mechanism in a modular fashion.
Figure 3:
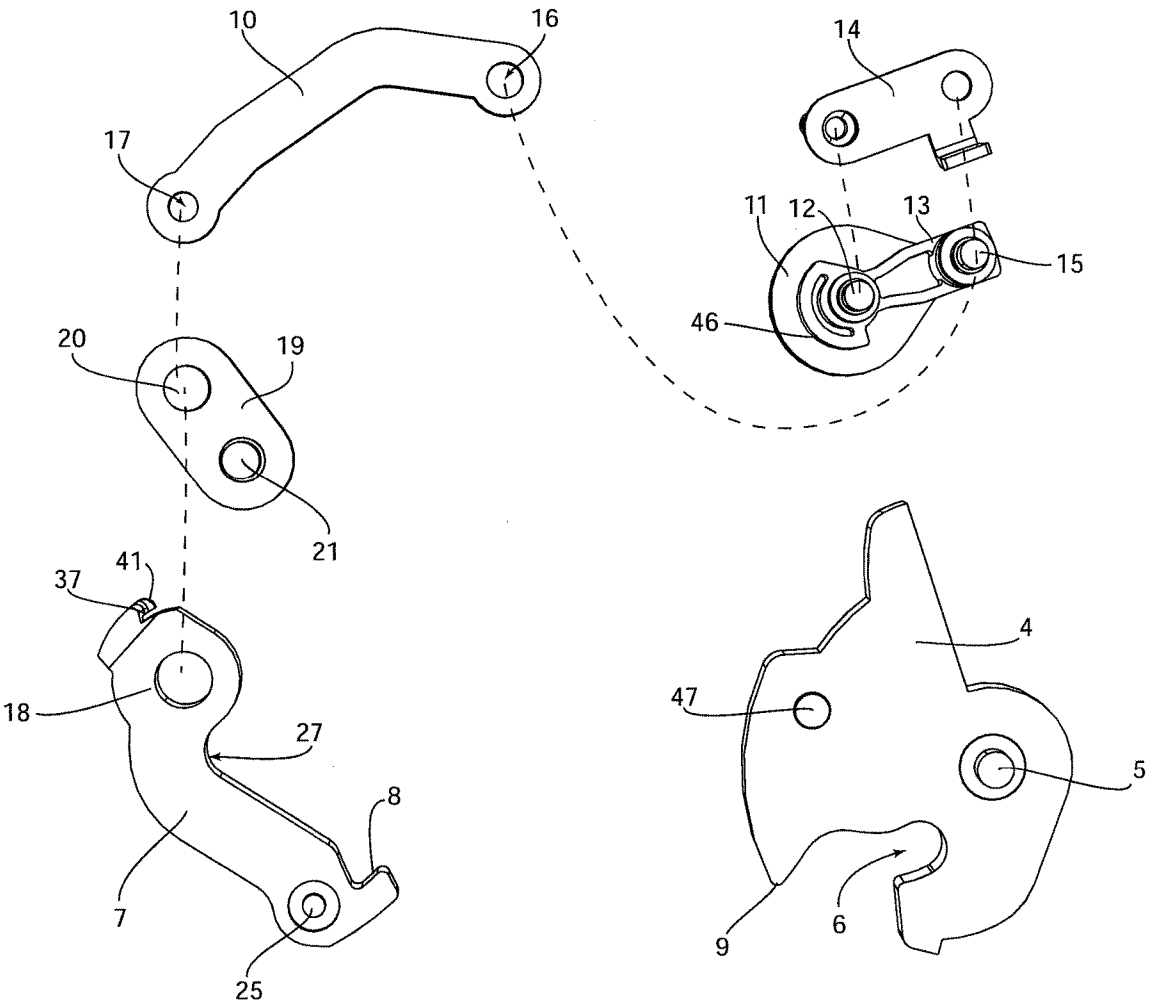
FIG. 3 shows the components required for the opening and closing of the vehicle door locking mechanism individually.

The particularly compact layout of the vehicle door locking mechanism "1" as presented in FIG. 1, is made possible due to the circumstance that the individual components are arranged in different, successive levels as hinted at in FIG. 2. This layout comprises a first level that contains the rotary latch "4", the locking pawl "7" and the articulating lever element "19" in addition to a closing lever "28", which can be rotated around a rotational axis "29" that is mounted on the housing element "3" and that secures the rotary latch "4" in the closing position of the vehicle door locking mechanism "1" so that the latch is prevented from rotating to the opening position. The locationally fixed rotary axis "29" is mounted on a sheet-like functional element "30", which is a component of the second and central layer structurally supported by the housing element "3". The immobilization element "31", which can be pivoted around a pivot axis "32" in a locationally fixed manner, is also a part of the second or central layer of the construction. The pre-detent lever "26", which is rotationally mounted on and around the pivot axis "32", a first sensor "33" for use in conjunction with the pre-detent lever "26", a lever-like signal element "34", which can be rotated around a rotational axis "35" and a second sensor "36" for the lever-like signal element "34" comprise the third layer. This compact layout allows for a complex and beneficial interaction of the individual components in addition to reducing the noise created by the opening movement. These advantages are detailed in the following.

Figure 8:
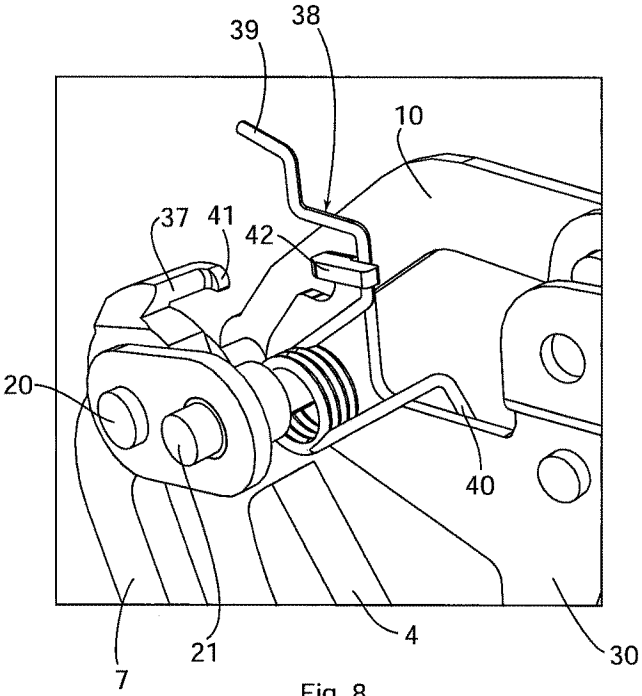
FIG. 8 shows an enlarged view of the area shown in FIG. 7, with the difference that the vehicle door locking mechanism is in its open position.
Figure 7:
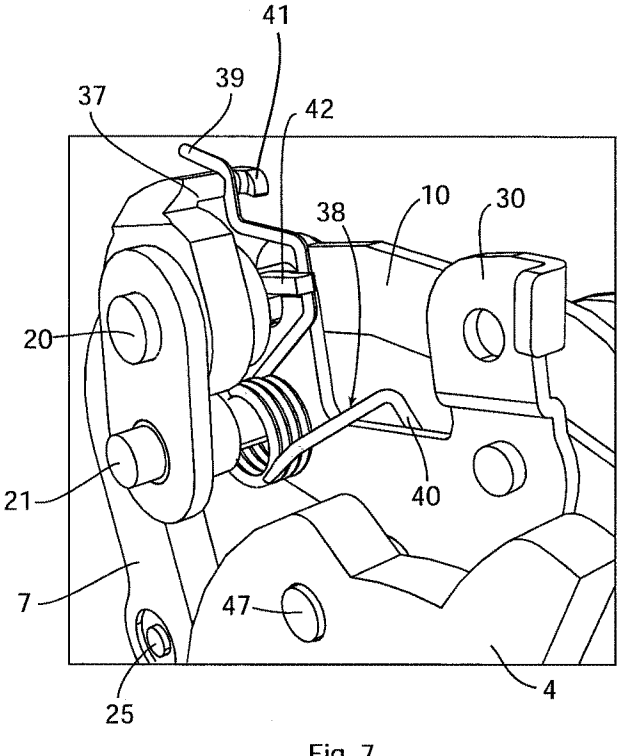
FIG. 7 shows an enlarged view of a specific section of the locking pawl of the vehicle door locking mechanism in the closed state.
Figure 6:
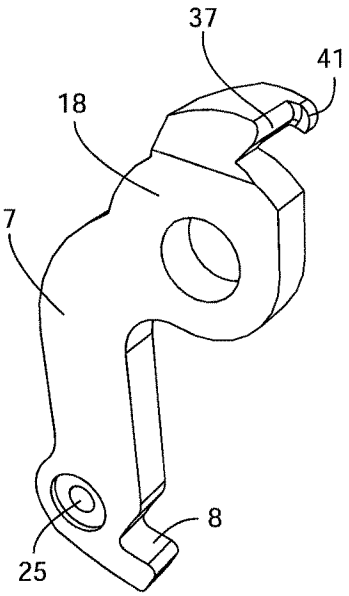
FIG. 6 shows a perspective view of a locking pawl of the vehicle door locking mechanism.

With any technologically advanced embodiment of the vehicle door locking mechanism "1", one of the primary goals is to reduce the power consumption and/or the driving force of the drive element "11". For this purpose, the invention intends that the coupling section "18" of the locking pawl "7" presses against the stop element in the engagement position (for example as shown in FIG. 4) in such a way that the locking section "8" of the locking pawl "7" is pushed in the direction of the rotary latch "4". To be more precise, a contact area "37" of the locking pawl "7" (shown in detail as part of the perspective view of the locking pawl "7" in FIG. 6) is in contact with a stopping element, which is designed to function as a spring element "38" (particularly as a leg spring) while in the engagement position. A first end or a first leg "39" of the spring element "38" pushes against the contact area "37" of the locking pawl "7" in the engagement position, whereas the other end or the second leg "40" of the spring element "38" rests on a functional element "30" while the central area of the spring element "38" is wound around the guiding axis as portrayed in the enlarged view of FIG. 7. The first leg "39" of the spring element "38" is secured against sliding off the contact area "37" in a lateral direction using a first retaining area "41" that is part of the contact area "37". The first leg "39" of the spring element "39" is also prevented from sliding off to the other side of the contact area "37" by a second retaining area "42", which is a part of the functional element "30". While in the engagement position, the first leg "39" of the spring element "38" elastically pushes against the contact area "37" of the locking pawl "7" in such a way that the locking pawl "7" pivots around the guiding axis "21" in opposition to the force exercised by the spring element "38", which causes the locking section "8" to be pushed in the direction of rotary latch "4" and then to be engaged with the locking arm "9" of the rotary latch "4". The spring element "38" is locationally fixed by a second retaining area "42", its central area leading around guiding axis "21" and a second leg "40", which is secured on functional element "30" to the functional element "30" in a locationally fixed manner. As soon as the locking pawl "7" is moved from the engagement position to the opening position, the contact area "37" of the locking pawl "7" moves away from the first end "39" of the spring element "38", which causes the force exercised by the spring element "38" to no longer affect the locking pawl "7" and especially the contact area "37". This ensures that the motorized opening aid that powers the drive element "11" for the purpose of moving the locking pawl "7" only has to provide the force required in order to move the locking pawl "7" to the opening position. Additional force to overcome the spring force exercised by the spring element "38" is evidently not required. This is due to the fact that as soon as the locking pawl "7" starts moving, which is, among other aspects, characterized by the movement of the coupling area "18" in a shape similar to a circular section, the contact area "37" is no longer in contact with the spring element "38". The opening position is portrayed in FIG. 8, which clearly shows that the contact area "37" no longer has an operative connection with the spring element "38". Through this interaction of the spring element "38" and the locking pawl "7" in accordance with the invention, the locking pawl "7" is spring-loaded in the engagement position in such a manner that the locking section "8" is forced in the direction of the rotary latch "4", whereas a movement of the locking pawl "7" from the engagement position to the opening position causes the locking pawl "7" to no longer be affected by the spring force of the spring element "38", because the coupling section "18" is pivoted away from the stationary, first end "39" of the spring element "38". The locking pawl "7" therefore undergoes something resembling a "load change", though the spring force of the spring element "38", which pushes the locking section "8" into the engagement position, is only effective when the vehicle door locking mechanism "1" is in the closed position. The spring element "38" therefore does not have an effect on the mechanism if the locking pawl "7" is deflected out of the engagement position. This allows for the use of a motorized drive unit with a lower power output for the operation of the vehicle door locking mechanism "1", as it is not required to overcome the spring force in order to move the locking pawl "7". Due to the lower power requirements regarding the motorized drive unit, it is possible to use a motor with a lower power output so that the overall construction space for the vehicle door locking mechanism "1" can be smaller. The lower power requirement as well as the reduced space requirements allow for the manufacturing costs associated with the production of the vehicle door locking mechanism "1" to be decreased further. However, the locking element "2" is still secured by the rotary latch "4" and the locking pawl "7" while in the closed position and the spring force of the spring element "38" is also effective in this position in order to ensure that the locking element "2" is securely closed in the event of a vehicle crash.

Figure 10:
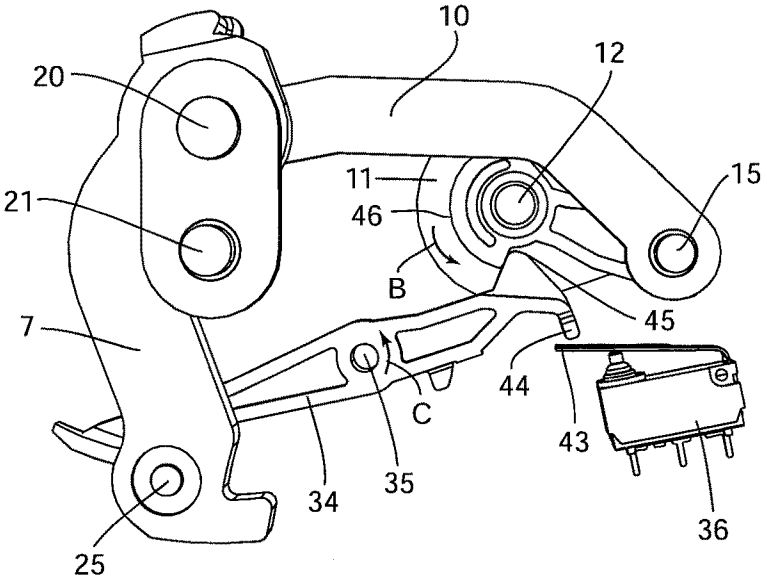
FIG. 10 shows a front view of the signal lever together with additional components of the vehicle door locking mechanism in the closed position.
Figure 9:
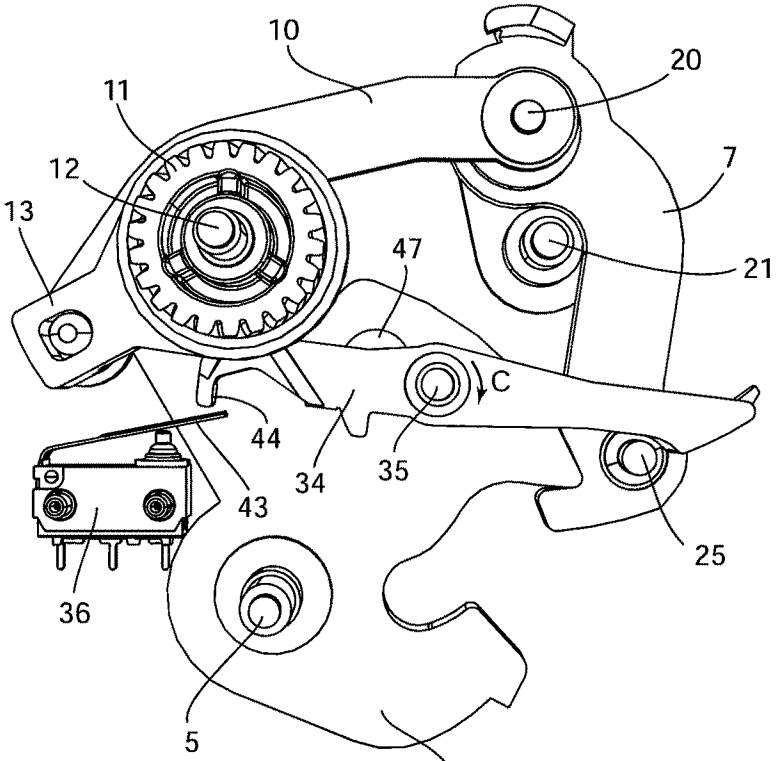
FIG. 9 shows a rear view of a signal lever together with additional components of the vehicle door locking mechanism in the closed position.
Figure 12:
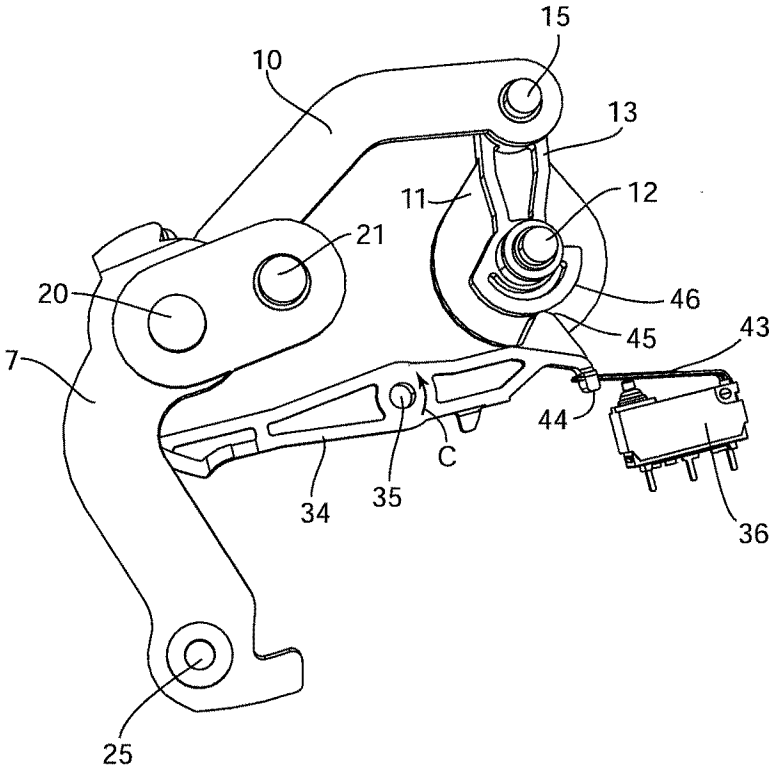
FIG. 12 shows a front view of the signal lever together with additional components of the vehicle door locking mechanism in the open position.
Figure 11:
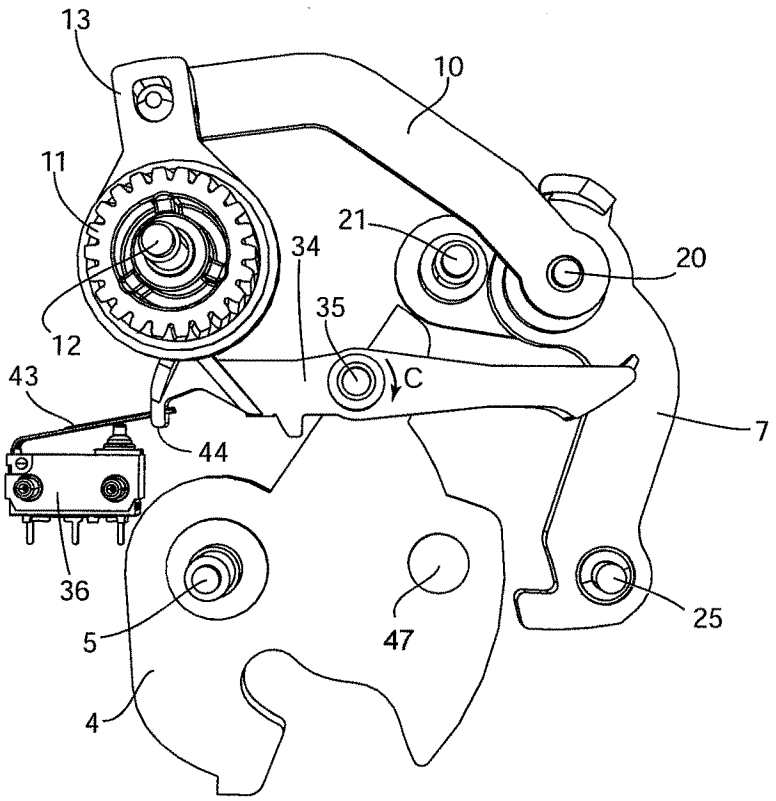
FIG. 11 shows a rear view of the signal lever together with additional components of the vehicle door locking mechanism in the open position.

Concerning the development of a new motor vehicle door locking mechanism, it is another objective of the designers and constructors to achieve that the new mechanism is made up of as few working components as possible and only requires a motor with a low power output. With the current state of the art, a motor controls the movement of the locking pawl "7" using a transmission of the drive element "11". The motor is switched on and off by two sensors, with both sensors responding to a particular transmission position and/or manual actuation elements of the sensors. The actuation usually takes place in the respective end positions of the open and closed position of the vehicle door locking mechanism by the respective sensors, which is why known and currently existing door locking mechanisms feature these two sensors. With the vehicle door locking mechanism in accordance with the invention described here, the extended objective is attained with the aid of a lever-like signal element "34". Due to the signal element "34" being rotatable around the rotary axis "35" in a manner similar to that of a "rocker", only a single sensor "36" is required in order to detect the main detent position or the engagement position of the vehicle door locking mechanism "1". If the sensor detects that the vehicle door locking mechanism "1" is not currently in between the engagement position and the open position, but is currently fully resting in the engagement position, then the power supply of the motor (not shown in detail as part of the Figures) is switched off so that the transmission is at a rest. The motor is connected with a micro-switch, which serves as the sensor "36". The working principle of the lever-like signal element is illustrated in FIGS. 9 to 12, with the vehicle door locking mechanism "1" being in the engagement position in FIGS. 9 and 10 and in the open position in FIGS. 11 and 12. The FIGS. 9 and 11 show a rear view of the signal lever "34", the second sensor "36", the drive element "11", the push rod element "10", the locking pawl "7" and the rotary latch "4", whereas the FIGS. 10 and 12 show a front view of the components although the rotary latch "4" is omitted in order to improve clarity. When in the engagement position, which is portrayed in FIGS. 9 and 10, an arm-shaped actuating element "43" of the micro-switch acting as the sensor "36" remains unactuated. The lever-like signal element "34" is spring-loaded and tends to rotate in the direction of the arrow "C". This tendency is therefore directed away from the actuation element "43" for an actuation surface "44", which is located on the end of the signal element "43" so that the signal element "34" is biased not to actuate the actuating element "43". Only for as long as the drive element "11" is in the engagement position is this bias possible for the signal element "34". A guiding surface "45" (see FIGS. 10 and 12) is located opposite from the actuating surface "44" on the end of the signal element "34". A guiding rod "46" that runs along the side area of the drive element "11" in a shape similar to a circular disc is provided on one of the side surfaces of the disc-shaped drive element "11". While in the engagement position, the guiding surface "45" is arranged laterally on the guiding rod "46" as shown by FIG. 10. The loading of the signal element "34" with the spring force in the direction of arrow C leads to the circumstance that the signal element "34" does not actuate the actuation element "43", which indicates that the vehicle door mechanism "1" is in the engagement position and the motor can be switched off in order to reduce power consumption. As soon as the motor vehicle door mechanism "1" is supposed to be opened, the motor is supplied with power again and the drive element "11" coupled to the motor is driven in the direction of the arrow B (see FIG. 10). This causes the guiding rod "46" of the drive element "11" to push the guiding surface "45" in the direction of the actuation element "43", whereas a further rotation of the drive element "11" in the direction of the arrow B pushes the guiding surface "45" down onto the guiding rod "46" and lets it slide along the rod in the shape of a circular section causing the actuation surface "44" to actuate the actuation element "43", which indicates to the sensor "36" that the drive element "11" is no longer in the engagement position and that the motor is not supposed to be switched off. In accordance with the invention, the drive element "11" and the lever-like signal element "34" therefore serve to detect both the engagement position and the non-engagement position. The signal element "34" can thus detected two positions, while the drive element "11" deflects the signal element "34" in opposition to the force exercised by the spring element in order to activate the sensor "36" in the non-engagement position. The "activation" is ultimately the actuation of the actuation element "43" in order to show that the drive element "11" is not located in the engagement position. In the manner described above, a single sensor is entirely sufficient for the determination of positions and/or the determination of the operation state of the vehicle door lock mechanism "1" so that one sensor can be omitted as compared to the current state of the art where two sensors are used to determine the positions of various components of the vehicle door lock mechanism "1".

Figure 14:
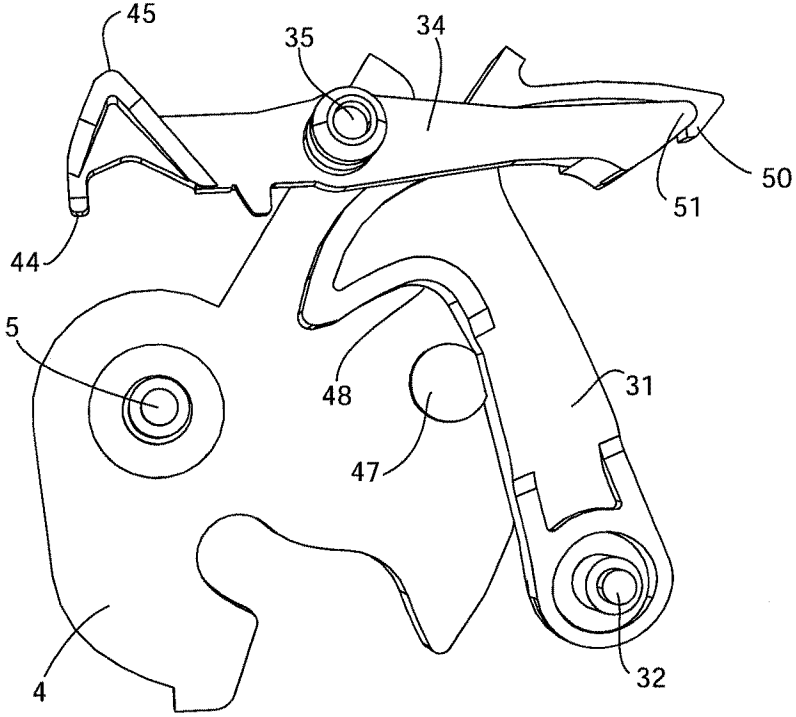
FIG. 14 shows a rear view of the interaction of the rotary latch with the immobilization element and signal element in the open position.
Figure 17:
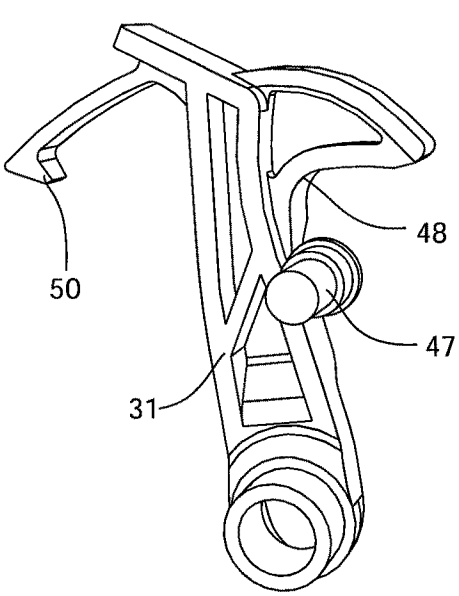
FIG. 16 shows a plan view of the immobilization element together with a setting element of the rotary latch in the open position and FIG. 17 shows a slightly perspective view of the immobilization element with the setting element of the rotary latch from FIG. 16.
Figure 16:
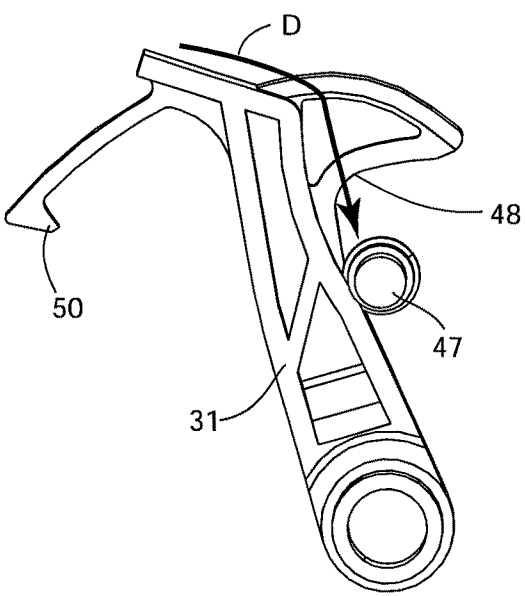
Figure 15:
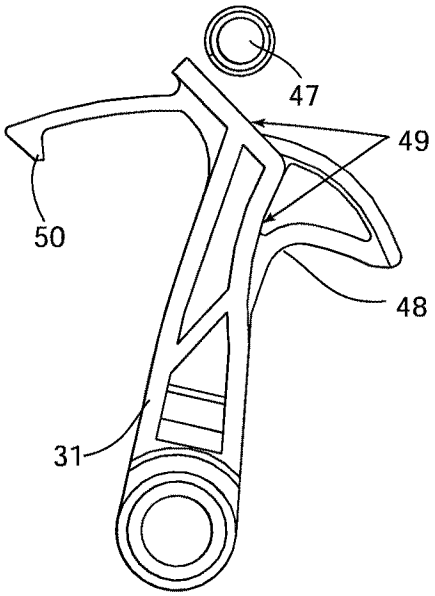
FIG. 15 shows a plan view of the immobilization element together with a setting element of the rotary latch in the closed position.

The current state of the art also features a rubber buffer for the locking element "2" to prevent the latter from causing any rattling noises while the vehicle door locking mechanism "1" is in the closed position where the locking element is located inside the rotary latch trap "6". However, such a rubber buffer increases the closing force that is required to bring the vehicle door locking mechanism "1" from the open position to the closed position. In order to avoid this advantage, yet another objective of this invention is to provide a constructively simple option for securing the locking element "2" within the rotary latch trap "6" without requiring any additional force while at the same time suppressing any possible rattling noises. This is achieved using the immobilization element "32" already shown as part of FIG. 2, which is also shown in detail as part of FIGS. 13 to 17 in which merely the most important components of the vehicle door locking mechanism "1" are shown for the purpose of explaining the functionality of the immobilization element "31". The lever-like and T-shaped immobilization element "31" is rotationally mounted on the pivot axis "32" fitted to one of the ends of the housing element "3" and acts in conjunction with a setting element "47", the rotary latch "4" and a lever-like signal element "34" whenever the rotary latch "4" rotates from the locked position (FIGS. 13 and 15) to the open position (FIGS. 14, 16 and 17). In order to ensure that the locking element "2" fits into the rotary latch trap "6" of the rotary latch "4" in a rattle-free manner while in the closed or closing position, the lever-like immobilization element "31" is provided to prevent tolerance-dependent rattling noises of the locking element "2". Here, the immobilization element "31" has a wedging effect on the locking element "2" using the stopping edge "48" in the closed or closing position of the vehicle door locking mechanism "1". This wedging force acting on the locking element "2" in the locked position of the vehicle door locking mechanism "1" is due to a type of self-locking effect and can optionally be further increased using a spring force exerted by a leg spring. While in the locked position, the stopping edge "48" of the immobilization element "31" presses the locking element "2" into the rotary latch trap "6" so that the locking element "31" is encased within the rotary latch trap "6" without any play. In this regard, the immobilization element "31" actually allows for a certain degree of overstroke of the locking element "2", which even enables the latter to move slightly into the direction of the signal element "34", even though it is already engaged within the rotary latch trap "6". During the movement from the locking position to the opening position and/or the open position, it is now required that the clamping effect exerted on the locking element "2" by the immobilization element "31" is lifted or at least mitigated to such an extent that the clamping force does not hinder the opening of the vehicle door locking mechanism "1" in any way. For this purpose, it is intended that the immobilization element "31" is swiveled around pivot axis "32" and away from the position shown in FIGS. 13 and 15 in such a manner that the stopping edge "48" is deflected away from the rotary latch trap "6" and it is no longer in contact with the locking element "2". The rotary latch "4" is, to this end, coupled with the immobilization element "31". To be more precise, a rotation of the rotary latch "4" causes the setting element "47" to come into contact with the contact edge "49" of the immobilization element "31". The setting element "47" is radially offset in relation to the rotary axis "5" mounted on the rotary latch "4" in such a manner that a rotary motion of the rotary latch "4" causes a movement of the setting element "47" in the shape of a circular section. With this movement in the shape of a circular section, the setting element "47" moves along the contact edge "49" of the immobilization element "31", as shown by arrow D in FIG. 16, and causes the previously described deflection of the immobilization element "31". The end of the deflection movement of the immobilization element "31" is defined by a hook-shaped locking element "50", which is located on the end of the immobilization element "31" opposite from the pivot axis "32", that is brought into engagement with a locking detent "51". The locking detent "51" is in this regard located on the end of the lever-like signal element opposite from the actuation surface "44". While in the open position of the vehicle door locking mechanism "1", the latching element "50" of the immobilization element "31" is engaged with the latching surface "51" of the signal element "34" in such a way that the contact edge "48" is arranged outside of the area belonging to the rotary latch trap "6". In this manner, it is possible to move the locking element "2" into the rotary latch trap "6" during the movement of the vehicle door locking mechanism "1" from the open to the closed position. Only after that will the contact edge "48" of the immobilization element "31" be brought into contact with the locking element "2". The lever-like signal element "34" is spring-loaded in the direction of arrow C (see FIG. 14), whereas signal element "34" rotates into the position shown in FIG. 13 when the guiding rod "46" of the drive element "11" no longer pushes against the guiding surface "45" of the signal element "31", which is the case while the device is in the closed state. If the spring-loaded signal element "34" thus rotates to the indicated position, the immobilization element "31" is taken out of engagement with the signal element "34". Due to the fact that the immobilization element "31" is spring-loaded, the immobilization element "31" swivels back around pivot axis "32" to the position shown in FIG. 13, while the rotary latch "4" and the locking element "2" do not have to be located at the position indicated in the stated Figure at this time, but only have to reach this position in a time-delayed fashion. In accordance with the execution example presented in the Figures, the lever-like immobilization element "31" is coupled to the rotary latch "4" via the setting element "47", which enables a rotary motion of the rotary latch "4" from the locking position to the opening position to move the contact edge "48" of the immobilization element "31" away from the rotary latch trap "6". With alternative embodiments, it would also be conceivable to implement this coupling using the pre-detent lever "26", the locking pawl "7" or even the drive element "11" instead of the rotary latch "4".

Summarizing the aforementioned information, a motor vehicle door locking mechanism "1" has been presented here, which is distinguished from the current state of the art by reducing the noise development during opening to a minimum and especially minimizing the sound caused by the pressure discharge. This is achieved by ensuring that the locking pawl "7" and the rotary latch "4" are moved in relation to one another in such a way that the tailgate and the vehicle door locking mechanism "1" can move away from the locking element "2", which first causes the pressure or pre-stress applied on the tailgate to be reduced before the locking pawl "7" and the rotary latch "4" are ultimately brought out of the engagement area in order to release the locking element "2". This is in particular achieved by designing the opening process in such a way that the joint axis "20" is moved relative to the rotary axis "5" of the rotary latch "4", which causes the initially tangential movement of the locking section "8" of the locking pawl "7" towards the rotary latch "4" and then the radial movement of the component away from the rotary latch "4" to be performed.

The presented vehicle door locking mechanism "1" is also characterized by a drive unit that requires only very little installation space. This is possible because the movement of the locking pawl "7" out of the engagement position into the opening position causes the locking pawl "7" to be no longer spring-loaded by the spring element "38". The locking pawl "7" is exclusively spring-loaded by the force of the spring element "38" while in the engagement position and is decoupled from the spring element "38" as soon as the movement from the engagement position to the opening position is initiated.

Given the vehicle door locking mechanism "1" in accordance with the invention, the drive element "11" and the lever-like signal element "34" furthermore cooperate for the purposes of detecting the engagement and non-engagement positions, which only requires one sensor "36" for the detection of the locking mechanism's position—instead of two sensors as is customary with the current state of the art.

The vehicle door mechanism "1" in accordance with the invention also includes an immobilization element "31", which is used to secure the locking element "2" within the rotary latch trap "6" without a need to apply an additional force and while suppressing any rattling noises at the same time. The immobilization element "31" is coupled with the rotary latch "4" so that the immobilization element "31" occupies different positions depending on the open or closed (locked) overall position of the mechanism.

Lastly, the invention also comprises a procedure for the opening of the vehicle door locking mechanism "1", in which the locking pawl "7" and the rotary latch "4" are taken out of engagement in order to open the tailgate by at least partially pivoting the locking pawl "7" away from the rotary latch "4". In this process, the locking pawl "7" is moved in the direction of the release position by the drive element "11" during the movement from the engagement position in such a way that the rotary latch "4" that is still engaged with the locking pawl "7" is moved in the direction of the opening position in conjunction with this movement. The drive element "11" used to open the vehicle door locking mechanism "1" is rotated in such a manner that the locking pawl "7" or at least a section of the locking pawl "7", meaning the locking section, is first moved primarily tangentially in relation to the locking pawl "7" during the movement out of the engagement position in the direction of the release position and then, in order to move the locking pawl "7" and rotary latch "4" out of engagement again, moved radially away from the rotary latch "4".

The invention comprises a vehicle door locking mechanism, which is distinguished by the aspects of a double knee-lever, the signal element, the immobilization element and the spring element that only applies force in the engagement position. The invention also comprises a vehicle door locking mechanism where the previously described aspects can be applied by themselves or in various combinations. Therefore, the invention described above is naturally not limited to the described and presented design embodiment. It is apparent that the embodiment portrayed in the drawing can be slightly modified by the responsible specialist in accordance with the intended application without the scope of the invention being invalidated. In this regard, the invention comprises all aspects and information contained in the description and/or presented in the drawing, including all that which the responsible specialist deems to be self-evident when deviating from the specific embodiment or design example.

The invention claimed is:

1. Vehicle door locking mechanism including a rotary latch that surrounds a locking element, mounted on a vehicle frame, in a locking position in which the rotary latch engages with the locking element, wherein the rotary latch is preloaded by a spring element into an opening position in which the rotary latch releases the locking element, a locking pawl, which is engaged with the rotary latch in an engagement position in such a way that the rotary latch is prevented from moving in the direction of the opening position, a drive element that is coupled with a coupling section of the locking pawl and that moves the locking pawl between the engagement position and a release position, at which the locking pawl no longer engages with the rotary latch, so that the rotary latch is capable of moving in the direction of the opening position, wherein a retaining area of a contact area of the locking pawl is in engagement with the spring element only when the locking pawl is in its engagement position, wherein the spring element exerts a spring-loaded force on the locking pawl in the engagement position of the locking pawl through the contact area, the spring-loaded force keeping the locking pawl engaged with the rotary latch, and wherein as soon as the locking pawl is moved out of the engagement position, the contact area of the locking pawl is no longer in contact with the spring element resulting in the locking pawl being no longer affected by the spring-loaded force.

2. Vehicle door locking mechanism in accordance with claim 1, wherein the contact area of the locking pawl is pressed against a leg of the spring element when in the engagement position in such a way that a locking section, which is located in a contact area opposite the locking pawl, is subjected to a force in the direction of the rotary latch.

3. Vehicle door locking mechanism in accordance with claim 1, wherein the spring element includes a first leg pushing against the contact area of the locking pawl in the closing position and a second leg resting on a housing element of the vehicle door locking mechanism in a fixed manner, wherein a movement of the locking pawl out of the engagement position results in the first leg of the spring element being moved and no longer being in contact with the contact area.

4. Vehicle door locking mechanism including:

a rotary latch that in a locking position surrounds a locking element, that is mounted to a vehicle frame, wherein in the locking position the rotary latch engages with the locking element and wherein the rotary latch is preloaded towards an opening position in which the rotary latch releases the locking element, a locking pawl, which is engaged with the rotary latch in an engagement position in such a way that the rotary latch is prevented from moving towards the opening position, a drive element coupled with a coupling section of the locking pawl, wherein the drive element moves the locking pawl between the engagement position and a release position, in which the locking pawl no longer engages with the rotary latch, so that the rotary latch is capable of moving towards the opening position, a lever-like signal element cooperates with the locking pawl and is adapted to be rotated around a rotary axis, wherein a rotary position of the signal element indicates the engagement position of the locking pawl, and wherein the drive element includes a guiding rod that pushes against a guiding surface located on an end of the signal element when the locking pawl is moved out of the engagement position and thus rotates the signal element, wherein the rotary position of the signal element is dependent on the position of the drive element so that the signal element is adapted to detect both the engagement and release positions of the locking pawl depending on the rotary position of the signal element.

5. Vehicle door locking mechanism in accordance with claim 4, wherein the signal element cooperates with a sensor in such a way that a rotation of a signal element together with a simultaneous movement of the locking pawl out of the engagement position is adapted to actuate an actuating element of the sensor via an actuating surface which is located on a distal end of the signal element.

6. Vehicle door locking mechanism in accordance with claim 5, wherein the actuation of the actuation element of the sensor indicates that the locking pawl is not in its engagement position.

7. Vehicle door locking mechanism in accordance with claim 5, wherein the actuation element of the sensor is actuated when the locking pawl is in the engagement position.

8. Vehicle door locking mechanism including a rotary latch that in a locking position surrounds a locking element, which is mounted to a vehicle frame, wherein in the locking position the rotary latch engages with the locking element and is preloaded towards an opening position in which the rotary latch releases the locking element, a locking pawl engaged with the rotary latch in an engagement position in such a way that the rotary latch is prevented from moving towards the opening position, a drive element coupled with a coupling section of the locking pawl and adapted to move the locking pawl between the engagement position and a release position, in which the locking pawl no longer engages with the rotary latch, so that the rotary latch is capable of moving towards the opening position, wherein the locking element in the locking position is clamped in a motion-inhibiting manner by the rotary latch, and an immobilization element coupled with the rotary latch and adapted to be rotated around a pivot axis.

9. Vehicle door locking mechanism in accordance with claim 8, wherein the immobilization element is coupled to the rotary latch in such a manner that a movement of the rotary latch towards the opening position causes the immobilization element to pivot away from the rotary latch in order to release the locking element.

10. Vehicle door locking mechanism in accordance with claim 9, wherein the rotary latch includes a setting element which is radially offset in relation to the rotary axis, the setting element deflecting the immobilization element away from the rotary latch in case the rotary latch is moved in the direction of the opening position.

11. Vehicle door locking mechanism in accordance with claim 8, wherein the immobilization element is held in a latching position away from the rotary latch when the rotary latch is in the opening position.

12. Vehicle door locking mechanism in accordance with claim 11, wherein the immobilization element includes a latching element, which engages with a latching surface on an end of a rotationally mounted and lever-like signal element while in the latching position.

13. Vehicle door locking mechanism in accordance with claim 8, wherein the immobilization element includes a curved stopping edge, which pushes against the locking element in the locking position of the rotary latch.

* * * * *